US005207280A

United States Patent [19]

Rodert et al.

[11] Patent Number: 5,207,280

[45] Date of Patent: May 4, 1993

[54] DEVICE IN HAMMER MACHINES

[75] Inventors: Jörgen Rodert, Saltsjö-boo; Kurt Andersson, Tyresö, both of Sweden

[73] Assignee: Uniroc AB, Fagersta, Sweden

[21] Appl. No.: 879,937

[22] Filed: May 8, 1992

[30] Foreign Application Priority Data

May 30, 1991 [SE] Sweden ..... 9101639

[51] Int. Cl.[5] ..... E21B 1/02; E21B 21/10

[52] U.S. Cl. ..... 173/105; 173/73; 173/131

[58] Field of Search ..... 173/73, 78, 80, 190, 173/105, 131, 206; 175/135, 162, 173, 189

[56] References Cited

U.S. PATENT DOCUMENTS

| | | | |
|---|---|---|---|
| 1,115,898 | 11/1914 | Carter | 173/80 |
| 2,951,467 | 9/1960 | Morrison | 173/73 X |
| 3,050,032 | 8/1962 | Carey | 173/73 X |
| 3,322,207 | 5/1967 | Foster | 173/73 |
| 3,329,221 | 7/1967 | Walker | 173/73 X |
| 3,410,353 | 11/1968 | Martini | 173/73 |
| 3,747,694 | 7/1973 | Kollandsrud | 173/105 X |
| 4,993,504 | 2/1991 | Rodert et al. | 173/105 X |

FOREIGN PATENT DOCUMENTS 8900590A 8/1990 Sweden .

*Primary Examiner*—Frank T. Yost
*Assistant Examiner*—Rinaldi Rada
*Attorney, Agent, or Firm*—Eric Y. Munson; Mark P. Stone

[57] ABSTRACT

Device in hammer machines. The device comprises a machine housing (1) and a hammer piston (2) movable to-and-fro in the machine housing. A drilling tool connected to the machine housing comprises a drill bit (5), a set of tubes (4) for rotating the drill bit and a set of rods (3) for transferring impact energy to the drill bit. A rod (11) situated adjacent to the drill bit is provided with an axial channel (7) and a radial channel (8) for supplying flushing medium to the flushing channel (6) of the drill bit. The distance (S) from the front end (9) of the drill bit to channel (8) is larger than the length (L) of the hammer piston (2).

2 Claims, 1 Drawing Sheet

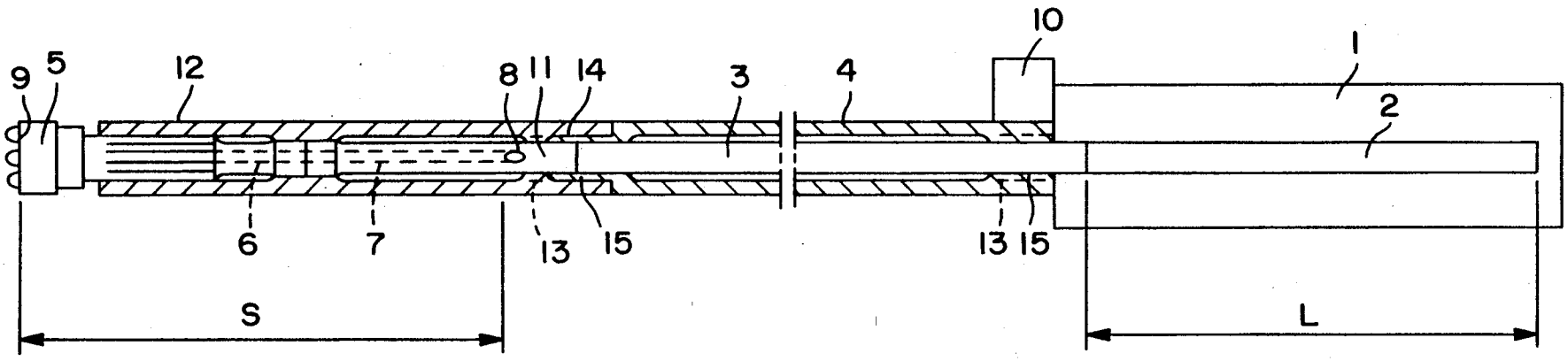
1
2
L
10
15
13
4
3
14
11
8
7
6
S
12
5
9

DEVICE IN HAMMER MACHINES

BACKGROUND OF THE INVENTION

The present invention relates to a device in hammer machines for drilling, preferably in rock, by means of a drill string comprising a set of tubes and a set of rods arranged in the set of tubes.

When drilling with drill strings of the above mentioned kind, see SE-A-8900590-4, one has used drill strings where the drill bit and the rod closest to the drill bit together have a length which is equal to the length of the hammer piston in order to efficiently transfer the energy of the hammer piston to the drill bit. The rod adjacent to the drill bit is provided with a channel which connects the external surface of the rod with a centrally positioned channel through which flushing medium is supplied to the drill bit. It has turned out that this build-up of the drill string in drilling creates large stresses in the rod at the channel between the external surface and the central channel. One reason for this is that the shock wave from the hammer piston has not passed the channel between the external surface and the central channel before the reflex from the rock reaches this section.

SUMMARY OF THE INVENTION

The present invention, which is defined in the subsequent claims, aims at achieving a device in hammer machines where the stress at the channel between the external surface of the rod and the central flushing channel is substantially reduced in order to improve the service life of the rod. It has surprisingly turned out that the drilling rate is not affected in any essential degree if the length of the drill bit and the adjacent rod is increased moderately. This deviates considerably from accepted opinions which say that the length of the drill bit and the adjacent rod together should be equal to the length of the hammer piston. It has turned out to be advantageous if the distance from the front end of the drill bit to the channel between the external surface of the rod and the central flushing channel is 5–10% larger than the length of the hammer piston.

BRIEF DESCRIPTION OF THE DRAWING

An embodiment of the invention is described below with reference to the accompanying drawing which schematically shows a rock drilling device according to the invention.

DESCRIPTION OF THE BEST MODES FOR CARRYING OUT THE INVENTION

The device shown in the drawing comprises a hammer machine which is provided with a machine housing 1 and a hammer piston 2 having a length L and being movable to-and-fro in the machine housing. A drilling tool, comprising a set of tubes 4, a set of rods arranged therein and a drill bit 5, is connected to the hammer machine. The set of tubes comprises a number of tubes which during drilling are connected with each other by means of thread connections 14. The set of rods comprises a number of rods loosely resting against each other for transferring the impact energy of hammer piston 2 to drill bit 5. Drill bit 5 is by means of a splined coupling 12 connected with the set of tubes 4. The set of tubes and thus the drill bit 5 is rotated by a rotation device 10. The drill bit is provided with an end 9 which is turned away from the machine housing 1 and an axial flushing channel 6. Adjacent to the drill bit a rod 11 forming part of the set of rods 3 is arranged. Rod 11 is provided with an axial channel 7 and a further channel 8 which connects the axial channel with the external surface of the rod. Flushing medium for removal of drill cuttings is supplied through the space between the set of rods and the set of tubes to the further channel 8 and from there through channels 7 and 6 to the front surface 9 of the drill bit. The set of tubes 4 is provided with guides 15 for the set of rods 3. These guides are provided communications 13 for passage of flushing medium. In order to decrease the stresses in the material at channel 8 the distance S between the end 9 of the drill bit turned away from the machine housing and channel 8 is larger than the length L of hammer piston 2. Through this it is ensured that the shock wave generated by the hammer piston passes channel 8 before the reflex from the rock reaches channel 8. The distance S is suitably 5–10% larger than the length L of hammer piston 2.

We claim:

1. Device in hammer machines comprising a machine housing (1), a hammer piston (2) mounted for reciprocal movement in the machine housing and arranged to deliver impacts against a tool, and a rotation device (10) for rotating the tool, the tool comprising a drill bit (5) provided with an axial flushing channel (6), a central set of rods (3) for transferring impact energy from the hammer piston to the drill bit, a set of tubes (4) about the set of rods for transferring rotation from the rotation device to the drill bit, and a rod (11) adjacent to the drill bit and provided with an axial channel (7) and a further channel (8) connecting said axial channel with the external surface of said rod, said device being arranged such that the distance (S) between an end (9) of the drill bit (5) remote from the machine housing (1) and said further channel (8) is greater than the length (L) of the hammer piston.

2. Device according to claim 1, wherein the distance (S) between the end (9) of the drill bit (5) remote from the machine housing (1) and said further channel (8) is between 5–10% greater than the length (L) of the hammer piston.

* * * * *